US012674369B1

(12) United States Patent
Loov et al.

(10) Patent No.: US 12,674,369 B1
(45) Date of Patent: Jul. 7, 2026

(54) ANNULAR WATER SHUTOFF SYSTEM AND METHODS OF USE THEREOF

(71) Applicant: Schlumberger Technology Corporation, Sugar Land, TX (US)

(72) Inventors: Robert Loov, Aberdeen (GB); Matthew Edward Billingham, Paris (FR); Alhadi Zahmuwl, Bucharestd (RO); Nicolas Saltel, Rio de Janeiro (BR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/280,755

(22) Filed: Jul. 25, 2025

(51) Int. Cl.
*E21B 33/12* (2006.01)
*E21B 33/13* (2006.01)

(52) U.S. Cl.
CPC ..... *E21B 33/12* (2013.01); *E21B 33/13* (2013.01)

(58) Field of Classification Search
CPC ..... E21B 33/12; E21B 33/13
See application file for complete search history.

(56) References Cited

U.S. PATENT DOCUMENTS 1,594,448 A * 8/1926 Boynton ..... E21B 33/16 166/291
3,880,233 A * 4/1975 Muecke ..... E21B 43/045 166/205
2004/0251025 A1* 12/2004 Giroux ..... E21B 33/16 166/291
2011/0121516 A1* 5/2011 Hallundbæk ..... E21B 43/103 277/316
2012/0103607 A1* 5/2012 Fitzpatrick ..... E21B 23/00 166/278
2015/0211328 A1* 7/2015 Lowry ..... C09K 8/00 166/135
2015/0345250 A1* 12/2015 Murphree ..... E21B 33/138 166/292
2020/0056444 A1* 2/2020 Benzie ..... E21B 33/1204
2020/0325749 A1* 10/2020 Fripp ..... E21B 33/10
(Continued)

OTHER PUBLICATIONS

"Advanced solutions for unwanted fluid production", Halliburton, Retrieved from the internet: https://www.halliburton.com/en/completions/well-intervention-and-diagnostics/custom-chemistry/unwanted-fluid-production, Retrieved date: Dec. 9, 2025, 7 Pages.
(Continued)

*Primary Examiner* — Neel Girish Patel
(74) *Attorney, Agent, or Firm* — Jeffrey D. Frantz

(57) ABSTRACT

Aspects of the present disclosure provide a method for sealing an annulus of a wellbore. The method including: lowering a tubular patch into a tubular to a desired seal location, wherein the tubular is disposed in a wellbore and includes one or more openings extending from an outer surface of the tubular to an inner surface of the tubular, the tubular patch including: an outer diameter of the tubular patch smaller than an inner diameter of the tubular and a first chemical disposed on an outer surface of the tubular patch; expanding the tubular patch within the tubular at the desired seal location; and exposing the first chemical to a second chemical, wherein the first chemical and second chemical react to form a sealing agent and the sealing agent expands through the one or more openings to fill an annulus between the tubular and the wellbore.

11 Claims, 14 Drawing Sheets

(56) References Cited

U.S. PATENT DOCUMENTS

| | | | | |
|---|---|---|---|---|
| 2022/0010651 | A1* | 1/2022 | Egbe | E21B 33/138 |
| 2022/0186579 | A1* | 6/2022 | Pelto | E21B 23/06 |
| 2022/0282590 | A1* | 9/2022 | Fripp | E21B 33/127 |

OTHER PUBLICATIONS

"Aubin® XMAX", Italmatch Chemicals, Retrieved from the internet: https://www.aubingroup.com/products/well-technology/xmax/, Dec. 9, 2025, 6 Pages.
"Expandable steel patches", SLB, Retrieved from the internet: https://www.slb.com/products-and-services/innovating-in-oil-and-gas/well-intervention/remedial-services/casing-repair/expandable-steel-patches, Retrieved date: Dec. 9, 2025, 10 Pages.
"Impermeable Subsurface Barriers", Resolute, retrieved from the internet: https://www.resolute-energy.co.uk/, Retrieved date: Dec. 9, 2025, 3 Pages.
"Innovation Built in", TAM International, Retrieved from the internet: https://www.tamintl.com/, Retrived date: Dec. 9, 2024, 11 Pages.
"Innovative Engineered Well Sealing Solutions", BiSN, Retrieved from the internet: https://bisn.com/, Retrieved date: Dec. 9, 2025, 19 Pages.
"Isealate Springblade Patch", Welltec, retrieved from the internet: https://www.welltec.com, /products-services/intervention/isealate-springblade-patch, Retrieved date: Dec. 9, 2025, pp. 12.
"Local Expander—Annual Squeeze Tool", Renegade, Retrieved from the internet: https://renegadewls.com/local-expander/, 2025, 9 Pages.
"Making a Material Difference", isol8, Retrieved from the internet: https://isol8.com/, Retrieved date: Dec. 9, 2025, 14 Pages.
"Optimize productivity and maximize reservoir contact", Welltec, Retrieved from the internet: https://www.welltec.com/products-services/completion, Retrieved date: Dec. 9, 2025, 22 Pages.
"SqueezeCRETE", SLB, Retrieved from the internet: https://www.slb.com/products-and-services/innovating-in-oil-and-gas/well-construction/well-cementing/cemcrete-cementing-technology/squeezecrete-remedial-cementing-solution, Retreived date: Dec. 9, 2025, 1 Page.
"Surface-controlled electrically set bismuth alloy barrier", Wellstrom, Retrieved from the internet: https://wellstrom.com/, Retrieved date: Dec. 9, 2025, 4 Pages.
"The Future Well Secured", Interwell, Retrieved from the internet: https://interwell.com/, Retrieved date: Dec. 9, 2025, 15 Pages.
"Water and Gas Shutoff Capabilities", Weatherford, Retrieved from the internet: https://www.weatherford.com/documents/brochure/products-and-services/completions/water-and-gas-shutoff-capabilities/, 2011, 2 Pages.

* cited by examiner

ANNULAR WATER SHUTOFF SYSTEM AND METHODS OF USE THEREOF

BACKGROUND

The present disclosure generally relates to the oil and gas industry. More specifically, the present disclosure relates to annular water shutoff systems and methods of use thereof. Production of reservoir fluids from wells may be limited due to the onset of water production. Water production may occur due to the presence of water in an annulus of the well being produced. Water production may create hydrostatic pressure in production tubing, which subjects hydrocarbon producing zones to an unhealthy back pressure. Unhealthy back pressure may prevent reservoir fluids from being produced. Increasingly, initiatives to sequestrate water downhole rather than treating it at surface brings significant value to the industry.

Accordingly, there is a continuous need for improved systems and methods for annular water shutoff.

SUMMARY

Aspects of the present disclosure provide a method for sealing an annulus of a wellbore. The method including: lowering a tubular patch into a tubular to a desired seal location, wherein the tubular is disposed in a wellbore and includes one or more openings extending from an outer surface of the tubular to an inner surface of the tubular, the tubular patch including: an outer diameter of the tubular patch smaller than an inner diameter of the tubular and a first chemical disposed on an outer surface of the tubular patch; expanding the tubular patch within the tubular at the desired seal location; and exposing the first chemical to a second chemical, wherein the first chemical and second chemical react to form a sealing agent and the sealing agent expands through the one or more openings to fill an annulus between the tubular and the wellbore or the formation.

Aspects of the present disclosure provide a method for sealing an annulus of a wellbore. The method including: lowering a tubular patch into a tubular to a desired seal location, wherein the tubular is disposed in a wellbore including a casing and the tubular includes one or more openings extending from an outer surface of the tubular to an inner surface of the tubular, the tubular patch including: an outer diameter of the tubular patch smaller than an inner diameter of the tubular and a first chemical disposed on an outer surface of the tubular patch; expanding the tubular patch within the tubular at the desired seal location; and flowing a second chemical to an outer surface of the tubular, wherein the outer surface of the tubular patch including the first chemical interacts with the second chemical, and wherein the interaction between the first chemical and the second chemical forms a sealing agent and the sealing agent expands to fill an annulus between the tubular and the casing or the formation.

Aspects of the present disclosure provide a system for sealing an annulus of a wellbore. The system including a tubular, a tubular patch, and a first chemical. The tubular includes one or more openings extending from an inner surface of the tubular to an outer surface of the tubular. The tubular patch is disposed within the tubular and includes one or more seal rings disposed about an outer surface of the tubular patch and configured to seal between the outer surface of the tubular patch and the tubular. The first chemical is disposed on the outer surface of the tubular patch. The first chemical is configured to react with a second chemical to expand from the outer surface of the tubular patch, through the one or more openings, and outwardly from the outer surface of the tubular.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments. It is emphasized that, in accordance with the standard practice in the industry, various features are not drawn to scale. In fact, the dimensions of the various features may be arbitrarily increased or reduced for clarity of discussion.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Illustrative examples of the subject matter claimed below will now be disclosed. In the interest of clarity, not all features of an actual implementation are described in this specification. It will be appreciated which in the development of any such actual implementation, numerous implementation-specific decisions may be made to achieve the developers' specific goals, such as compliance with system-related and business-related constraints, which will vary from one implementation to another. Moreover, it will be appreciated which such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." For the sake of brevity, all similar components have been given similar reference numbers with the same last two digits and a full description of such similar components may not be repeated herein.

Aspects of the present disclosure provide annular water shutoff systems and methods of use thereof. The annular water shutoff system includes a tubular patch. The tubular patch is lowered into a tubular to a desired seal location. The desired seal location may be a location with water encroachment into an annulus around the tubular. The tubular may be a sand screen or may be another downhole tubular (e.g., casing). The tubular patch includes an outer diameter that is smaller than the inner diameter of the tubular and includes a chemical disposed on an outer surface of the tubular patch. The chemical is designed such that interaction with another chemical (i.e., a second chemical) will cause the product of the reaction to expand, fill empty space and seal the empty space. Once the tubular patch is at the desired seal location, the tubular patch is expanded. After the tubular patch is expanded, the chemical is exposed to the second chemical and the resulting sealing agent expands to fill the empty space (and the annulus) thus sealing the area of water encroachment.

Figure 1A:
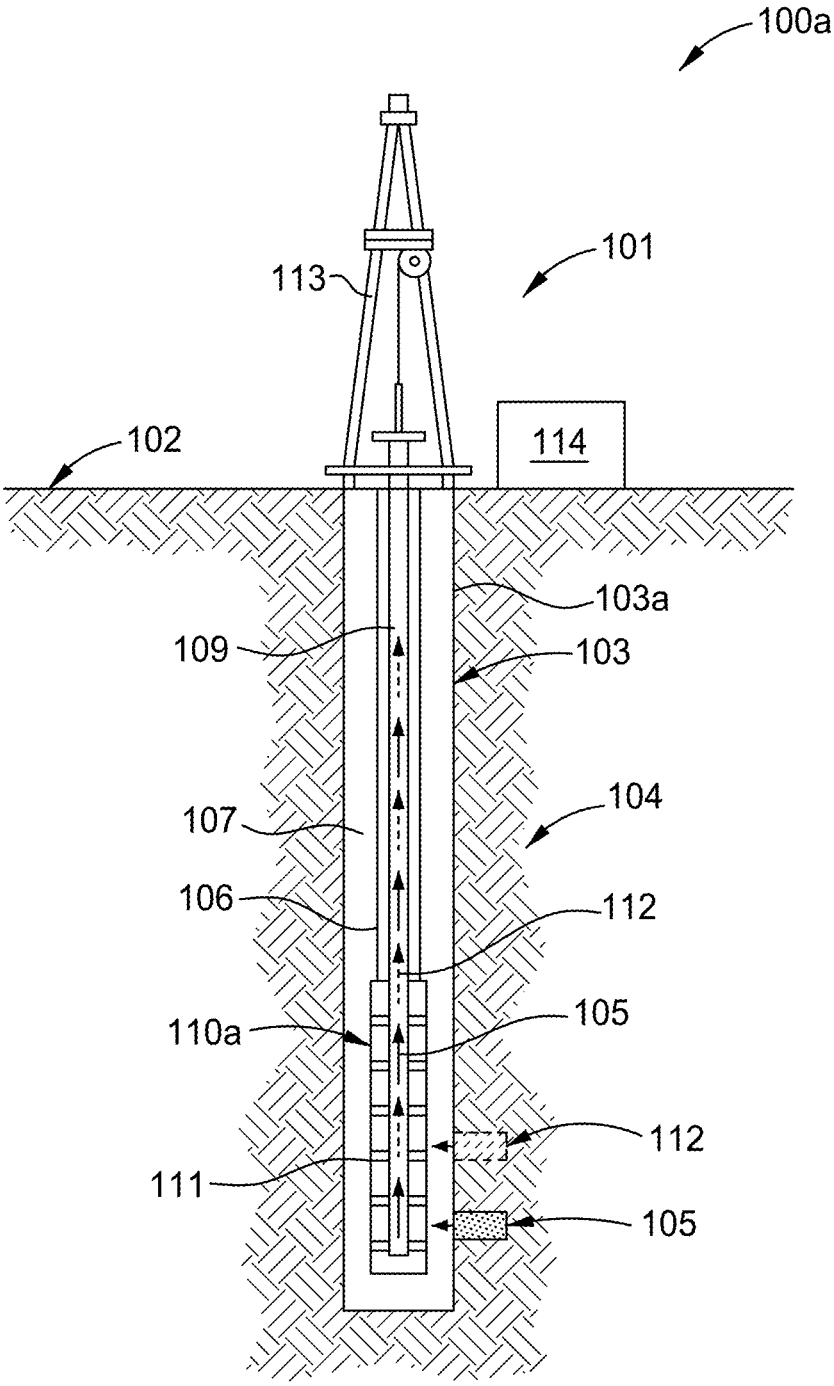
FIGS. 1A-1B illustrate schematic views of exemplary wellsites, according to one or more embodiments.
Figure 1B:
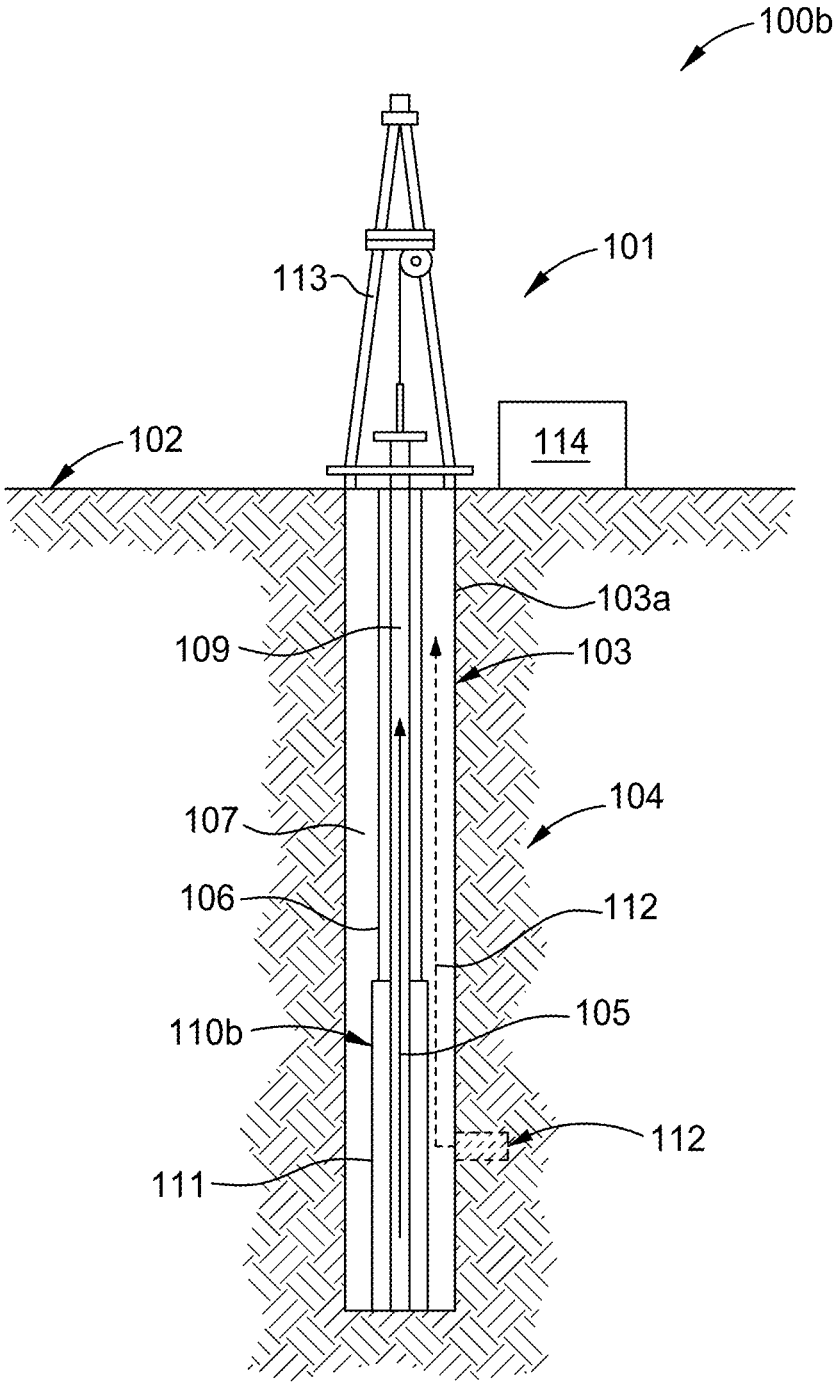

FIGS. 1A-1B illustrate schematic views of exemplary wellsites 100*a*, 100*b*. The wellsites 100*a*, 100*b* include surface equipment 101 disposed on a surface 102 above a wellbore 103 formed in a geological formation 104. The geological formation 104 may contain reservoir fluids 105 (e.g., hydrocarbons). Accordingly, the wellbore 103 may be utilized to extract (i.e., "produce") the reservoir fluids 105 disposed in the geological formation 104.

The wellbore 103 includes a tubular 106 disposed in the wellbore 103 including an inner bore 109. The tubular 106 and the wellbore 103 create an annulus 107. While the embodiments illustrated in FIGS. 1A-1B show the wellbore wall 103*a* as uncased, it is contemplated that the wellbore 103 may be cased (e.g., include a casing forming the inner surface of the wellbore wall), as illustrated in FIGS. 3A-3F. The tubular 106 may be a string of tubulars connected to one another creating a continuous bore 109.

As illustrated in FIG. 1A, the tubular 106 includes a sand screen 110*a*. The sand screen 110*a* includes perforations 111 used to produce reservoir fluids 105. According to one mode of operation, reservoir fluids 105 flow into the annulus 107, the reservoir fluids 105 flow into the bore 109 and the reservoir fluids 105 are flowed to the surface. Accordingly, when water 112 flows into the annulus 107 (such as through the formation 104 or failed equipment such as failed casing or other sealing equipment), the water 112 may be produced by flowing into the perforations 111 of the sand screen 110*a* and through the bore 109.

As illustrated in FIG. 1B, the tubular 106 may include an unperforated tubing 110*b*. Accordingly, the unperforated tubing 110*b* may be used to transport fluids (e.g., reservoir fluids 105, other chemicals, and/or hydraulic fluid) uphole or downhole. Accordingly, when water 112 flows into the annulus 107 (such as through the formation 104 or failed equipment such as failed casing or other sealing equipment), water 112 may be produced or may be otherwise mixed with the fluid within the unperforated tubing 110*b* (by, for instance, perforations and/or sand screens, and/or leaks uphole or downhole of the unperforated tubing 110*b*).

While FIGS. 1A-1B illustrate the tubular 106 to include a sand screen (such as sand screen 110*a*) and/or unperforated tubing (such as unperforated tubing 110*b*), it is contemplated that the method and system described herein may be used for any tubular 106 disposed in a wellbore 103 or may be used on bare casing wherein the annulus to be sealed is an annulus formed between the casing and the wellbore wall 103*a* or leak path formed in the formation 104, and/or wellbore wall 103*a*.

The surface equipment 101 may include a support system 113 for lowering and/or raising downhole tools into and out of the wellbore 103. In one or more embodiments, the surface equipment 101 further includes pumps, valves, manifolds, etc. used for producing reservoir fluids 105.

In one or more embodiments, the surface equipment 101 further includes a processing system 114. In one or more embodiments, the processing system 114 includes a controller. The controller may include a programmable central processing unit (CPU) which is operable with a memory (e.g., non-transitory computer readable medium and/or non-volatile memory) and support circuits. The support circuits are coupled to the CPU and includes cache, clock circuits, input/output subsystems, power supplies, and the like, and combinations thereof coupled to the various components of the processing system 114, to facilitate performing one or more operations of methods 200, 400. For example, in one or more embodiments the CPU is one of any form of general purpose computer processor used in an industrial setting, such as a programmable logic controller (PLC). The memory, coupled to the CPU, is non-transitory and is one or more of readily available memory such as random access memory (RAM), read only memory (ROM), floppy disk drive, hard disk, or any other form of digital storage, local or remote.

Herein, the memory is in the form of a computer-readable storage media containing instructions (e.g., non-volatile memory), that when executed by the CPU, facilitates well-site operations. The instructions in the memory are in the form of a program product such as a program that implements the methods of the present disclosure (e.g., middleware application, equipment software application, etc.). The program code may conform to any one of a number of different programming languages. In one or more embodiments, the disclosure may be implemented as a program product stored on computer-readable storage media for use with a computer system. The program(s) of the program product define functions of the embodiments (including the methods and operations described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

The various methods (such as methods 200, 400) and operations disclosed herein may generally be implemented under the control of the CPU of the processing system 114 by the CPU executing computer instruction code stored in the memory as, e.g., a software routine. When the computer instruction code is executed by the CPU, the CPU conducts operations in accordance with the various methods and operations described herein. In one or more embodiments, the memory (a non-transitory computer readable medium) includes instructions stored therein that, when executed, cause the method (such as the methods 200, 400) described herein to be conducted. The operations described herein can be stored in the memory in the form of computer readable logic.

While illustrated as being disposed on the surface 102, in one or more embodiments, the processing system 114 may be disposed downhole (i.e., in the wellbore 103) as part of a tool string.

Figure 2:
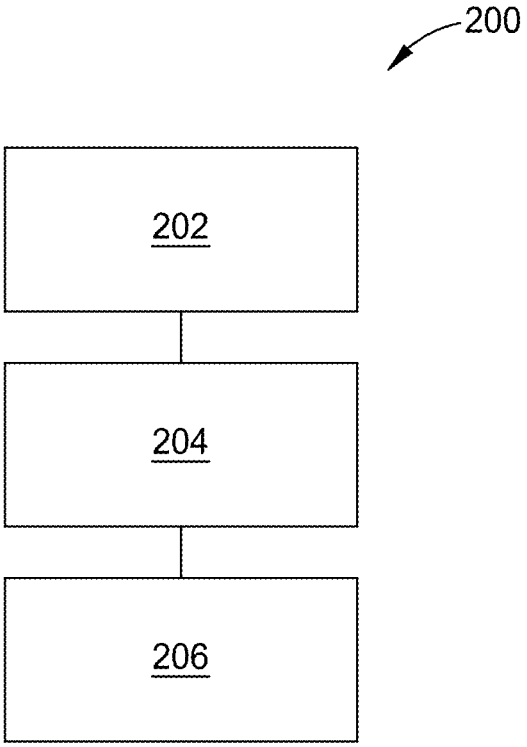
FIG. 2 illustrates a method for sealing an annulus of a wellbore, according to one or more embodiments.

FIG. 2 illustrates a method 200 for sealing an annulus (such as annulus 107 of FIGS. 1A-1B) of a wellbore (such as wellbore 103 of FIGS. 1A-1B). FIGS. 3A-3F schematically illustrate the method 200 for sealing an annulus 307 of a wellbore 303.

Figure 3A:
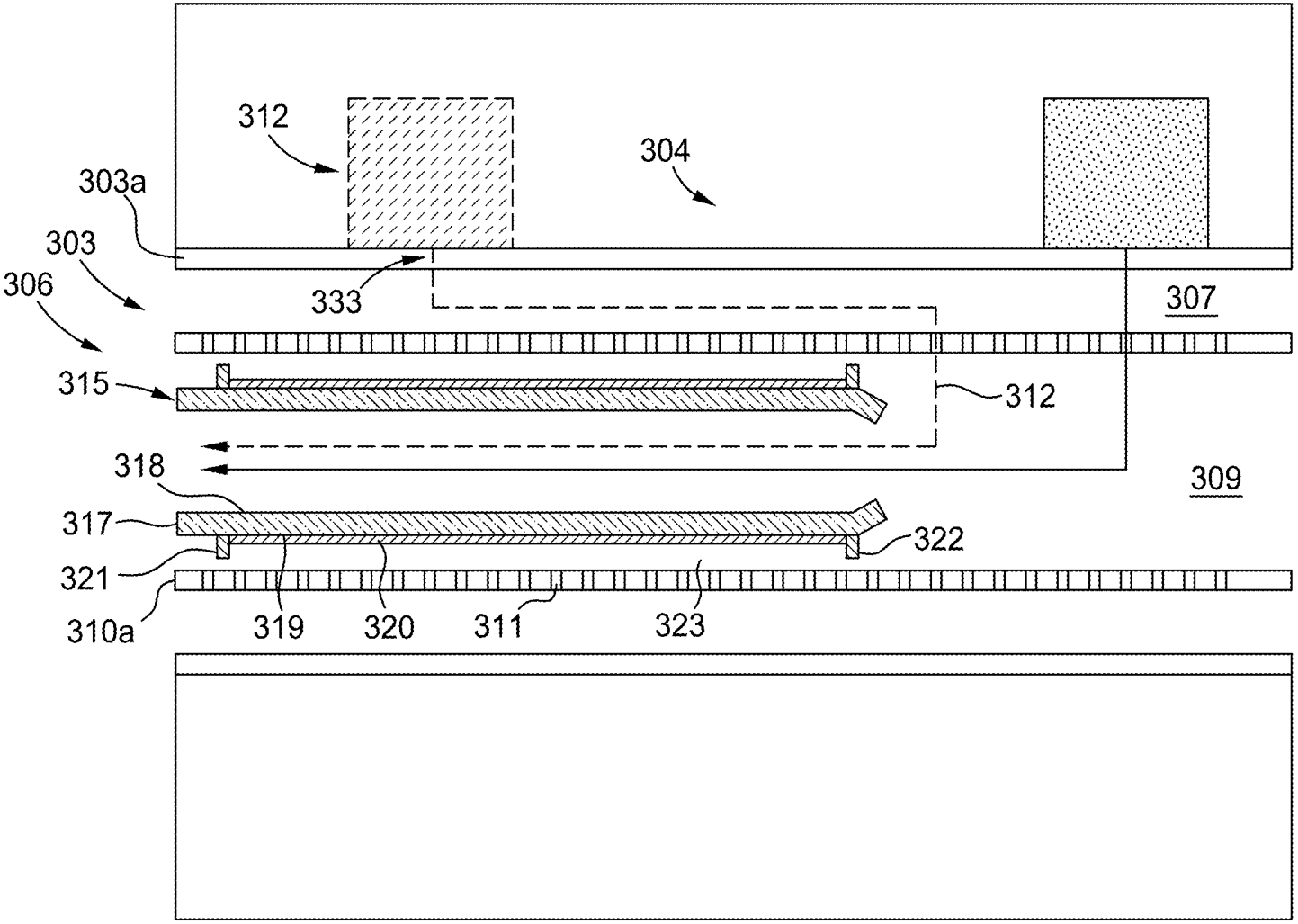
FIGS. 3A-3F schematically illustrate the method for sealing an annulus of a wellbore of FIG. 2, according to one or more embodiments.

At operation 202, and shown in FIG. 3A, a tubular patch 315 is lowered into the tubular 306 to a desired seal location. In the presently illustrated embodiment, the tubular 306 is a sand screen 310*a* and the sand screen 310*a* is disposed in a cased wellbore 303 (e.g., including a casing 303*a*). Accordingly, the tubular 306 includes perforations 311 (e.g., openings extending from an outer surface of the tubular 306 to an inner surface of the tubular 306). The desired seal location is a location in which the annulus 307 formed between the casing 303*a* and the outer surface of the tubular 306 needs to be sealed. In one or more embodiments, such as the presently illustrated embodiment, the desired seal location is a location in which water 312 is entering the annulus 307 through the casing 303*a* through a leak path 333. Similarly, in the presently illustrated embodiment, the desired seal location is at the same depth as the sand screen 310*a*. In one or more embodiments, the desired seal location may only be a portion of the sand screen 310*a* (e.g., only sealing a portion of the perforations 311 of the sand screen 310*a*).

The tubular patch 315 includes a tubular body 317 including an inner surface 318 and an outer surface 319. The tubular body 317 may be made of a pliable metallic material, such as austenitic stainless steels and super-alloys such as Nickel-based alloys. The tubular patch 315 includes a first chemical 320 disposed on the outer surface 319 of the tubular body 317. The first chemical 320 may be bonded to, coated on, painted on, or otherwise adhered to, the outer surface 319 of the tubular body 317. The first chemical 320 is configured to interact with a second chemical to form a sealing agent and expand to fill empty space as further discussed herein with respect to operation 206. In one or more embodiments, the first chemical 320 may include a polymer. In one or more embodiments, the first chemical 320 may include other chemical components such as a delay agent and a foam stabilizer. In one or more embodiments, the second chemical may be a cross-linked chemical and foaming agent. In one or more embodiments, the cross-linked chemical may be a polyacrylamide. In one or more embodiments, the second chemical may have a gas, such as nitrogen gas, added to the second chemical.

The tubular patch 315 includes a first seal ring 321 disposed about the tubular body 317 at a first end of the tubular body 317 and a second seal ring 322 disposed about the tubular body 317 at a second end of the tubular body 317. In one or more embodiments, the first chemical 320 is limited to the outer surface 319 of the tubular body 317 between the first seal ring 321 and the second seal ring 322. The first seal ring 321 and the second seal ring 322 have a larger outer diameter than the outer surface 319 of the tubular body 317. The first seal ring 321 and the second seal ring 322 create a sealed annulus 323 between the outer surface 319 of the tubular body 317 and the inner surface of the tubular. While illustrated as protruding substantially from the outer surface 319 of the tubular body 317 it is contemplated that the seal rings 321, 322 may only protrude a small amount from the outer surface 319 of the body 317. For instance, the first seal ring 321 and the second seal ring 322 may be O-rings or rings of bonded elastomer.

In one or more embodiments, the tubular body 317 includes a varying inner diameter. For example, as illustrated, the inner diameter may be smaller at a downhole end of the tubular body 317. The smaller inner diameter may allow for a ball and/or plug to be deployed into the tubular patch 315 to plug fluid communication through the tubular 306.

In one or more embodiments, the tubular patch 315 is lowered by surface equipment (e.g., support system 113) by, for example, wireline, coiled tubing, pipe, and/or may be positioned by being pumped into place.

Figure 3B:
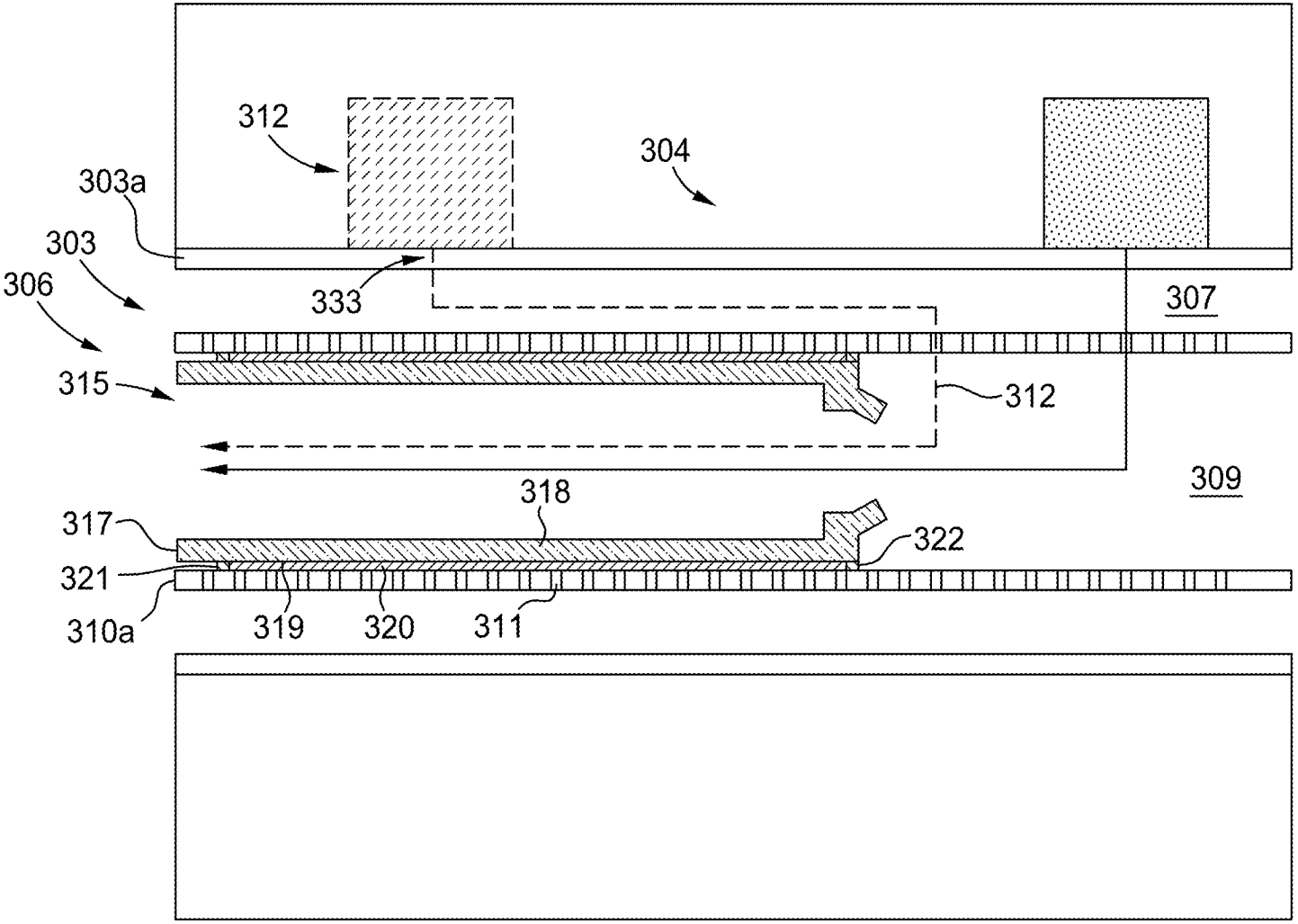

At operation 204, and as shown in FIG. 3B, the tubular patch 315 is expanded within the tubular 306 at the desired location. In one or more embodiments, the tubular patch 315 includes a deformable material such that the tubular patch 315 may be expanded. In one or more embodiments, the portion of the tubular patch 315 between the first seal ring 321 and the second seal ring 322 is expanded. In one or more embodiments, the portion of the tubular patch 315 between the first seal ring 321 and the second seal ring 322 is expanded such that the first chemical 320 and/or outer surface 319 of the tubular body 317 abuts the inner surface of the tubular 306. In one or more embodiments, the portion of the tubular patch 315 between the first seal ring 321 and the second seal ring 322 is expanded such that the first chemical 320 and/or the outer surface 319 of the tubular body 317 forms a seal with the inner surface of the tubular 306. In one or more embodiments, the portion of the tubular patch 315 between the first seal ring 321 and the second seal ring 322 is expanded to shrink the annulus 323 to between about 0.0 inches to about 1.0 inch. In one or more embodiments, with the portion of the tubular patch 315 between the first seal ring 321 and the second seal ring 322 expanded, the first seal ring 321 and the second seal ring 322 isolate the portion of the tubular patch 315 including the first chemical 320 from the interior of the tubular 306 and tubular patch 315. Accordingly, in such embodiments, fluid communication to the first chemical 320 may be limited to fluid communication through perforations 311.

In one or more embodiments, the tubular patch 315 is expanded using a downhole tool (e.g., an expanding tool). The downhole tool may be deployed by a wireline, coiled tubing, and/or piping. In one or more embodiments, the tubular patch 315 is hydraulically and/or fluidly expanded. In one or more embodiments, the tubular patch 315 is mechanically expanded, such as by cone expansion. For example, a fluid may be pumped to a tool to expand the tool and the tubular patch 315. In one or more embodiments, a fluid is pumped to the tubular patch 315 to expand the tubular patch 315 using pressure of the fluid. In one or more embodiments, a packer is used to expand the tubular patch 315. In one or more embodiments, a mechanical downhole tool is used to expand the tubular patch 315.

Figure 3C:
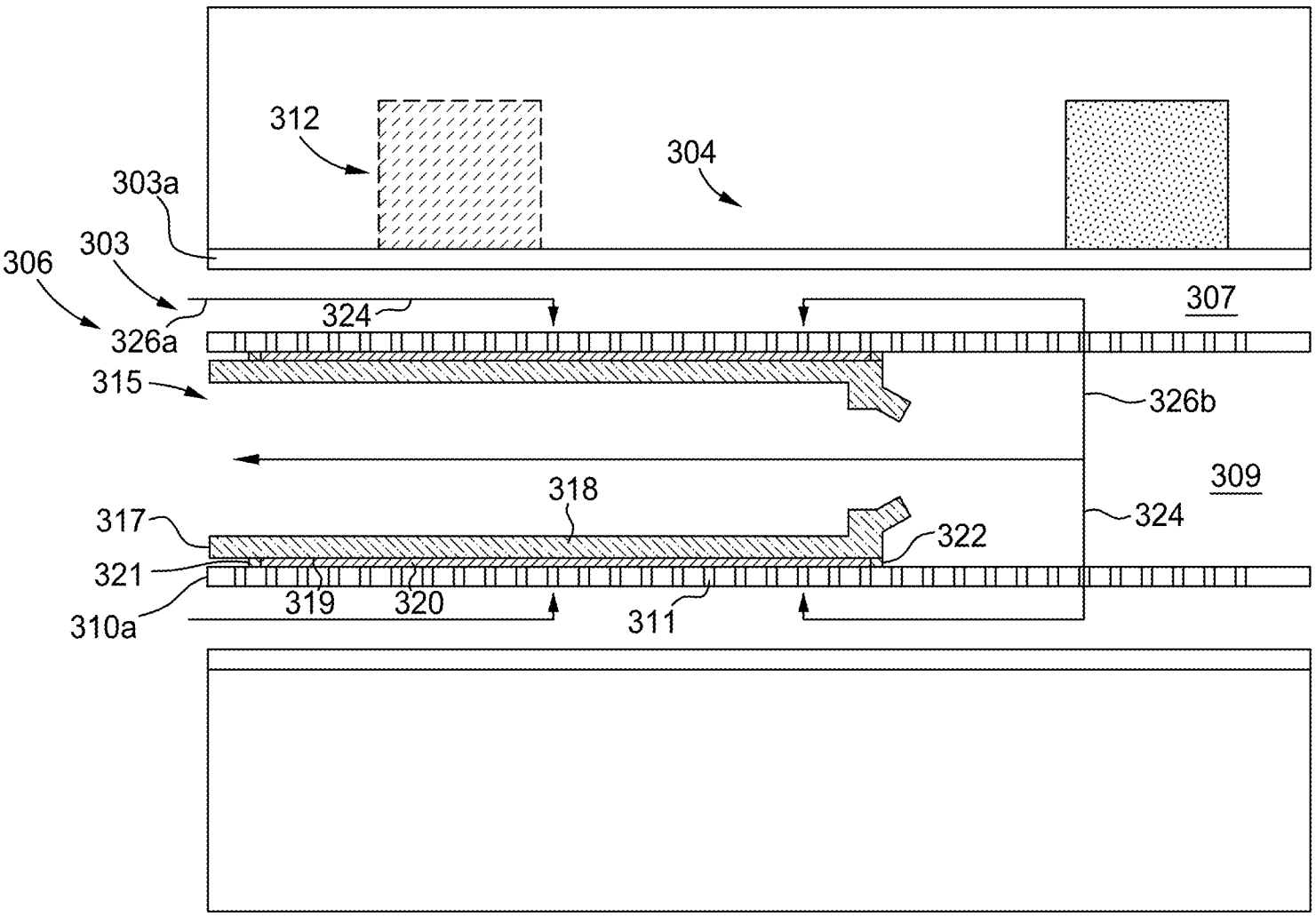

At operation 206, and as shown in FIG. 3C, the first chemical 320 is exposed to a second chemical 324. Exposing the first chemical 320 to the second chemical 324 forms a sealing agent 325, which expands to fill empty space, as shown in FIG. 3E. In one or more embodiments, the second chemical is the same second chemical described with respect to the embodiment shown and described with respect to FIGS. 3A-3F. In one or more embodiments, the sealing agent 325 that is formed is the same sealing agent described with respect to the embodiment shown and described with respect to FIGS. 3A-3F.

The sealing agent 325 expands to fill the annulus 323 between the first seal ring 321 and the second seal ring 322, expands through the perforations 311, and expands outwardly into the annulus 307. Accordingly, the annulus 307 at the desired sealing location is sealed, as shown in FIG. 3E. In one or more embodiments, such as the illustrated embodiment, the sealing agent 325 may further expand to seal the leak path 333 (such as through the casing 303*a*). Accordingly, the sealing agent 325 may appropriately seal an area of water encroachment (i.e., where water is entering the annulus 107 and/or the tubular 106). In one or more embodiments, the chemical makeup of the first chemical 320 and the second chemical 324 may include a chemical makeup such that the sealing agent 325 expands to only seal the desired sealing location (as compared to expanding further up or down the annulus 307 which may cause undesired blockages or seals in the annulus 307).

In one or more embodiments, exposing the first chemical 320 to the second chemical 324 includes flowing the second chemical 324 into contact with the first chemical 320. In one or more embodiments, flowing the second chemical 324 into contact with the first chemical 320 includes flowing the second chemical 324 through the annulus 307 (from uphole or downhole). In one or more embodiments, flowing the second chemical 324 into contact with the first chemical 320 includes flowing the second chemical 324 through the perforations 311 and into contact with the first chemical 320 (such as along flow path 326*a*). In one or more embodiments, flowing the second chemical 324 into the annulus 307 may include flowing the second chemical 324 through the tubular 306 and the tubular patch 315 and into the annulus 307 through a different section of the sand screen 310*a* (such as along flow path 326*b*). In one or more embodiments, flowing the second chemical 324 into the annulus 307 may include flowing the second chemical 324 through a different sand screen or section of perforations in the tubular string. In one or more embodiments, flowing the second chemical 324 includes using a fluid displacement tool. The fluid displacement tool (e.g., a pump) may be deployed downhole by a wireline, coiled tubing, and/or piping. In one or more embodiments, the fluid displacement tool may be disposed at the surface. In one or more embodiments, the second chemical 324 is bullheaded from the surface.

Figure 5A:
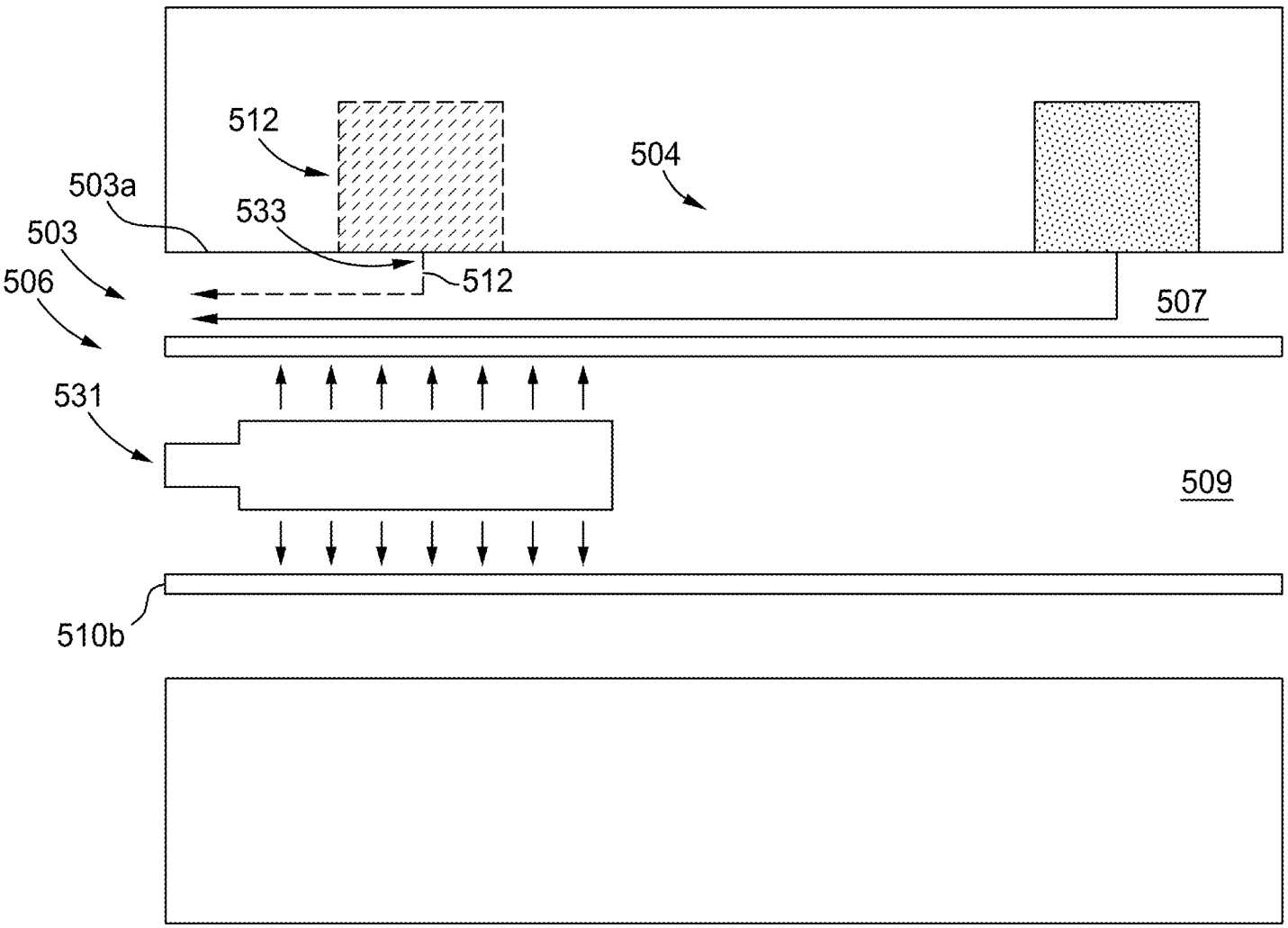
FIGS. 5A-5D schematically illustrate the method for sealing an annulus of a wellbore of FIG. 4, according to one or more embodiments.
Figure 5B:
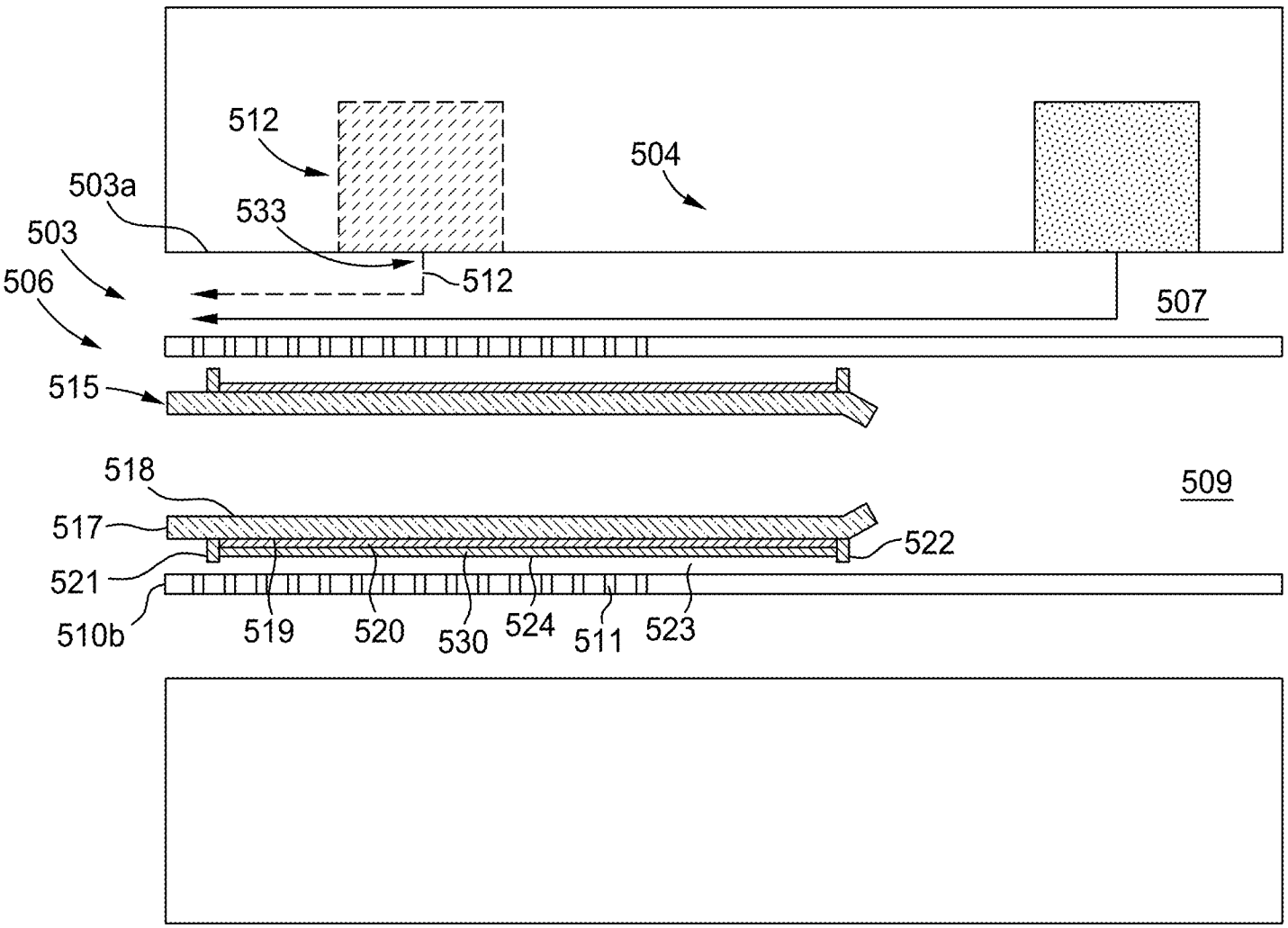

In one or more embodiments, as described in method 400 (at operation 406 and illustrated in FIGS. 5A-5B), the second chemical 324 may be contained downhole and may be released into contact with the first chemical 320. In one or more embodiments, the second chemical 324 may be contained in a reservoir (as illustrated in FIGS. 5A-5B). In such embodiments, the reservoir containing the second chemical 324 may be part of the tubular patch 315 (as illustrated in FIGS. 5A-5B). In one or more embodiments, the reservoir may be separate from the tubular patch 315. For example, the reservoir may be attached to a separate downhole tool or a separate part of the tubular string. In one or more embodiments, the reservoir may be opened by rupturing (such as is described in method 400), may be opened by the actuation of valves, or may be otherwise actuated to release the second chemical 324. In one or more embodiments, the second chemical 324 may be released simultaneously with the expanding of the tubular patch 315. In one or more embodiments, the second chemical 324 may be released after expanding of the tubular patch 315.

Figure 3D:
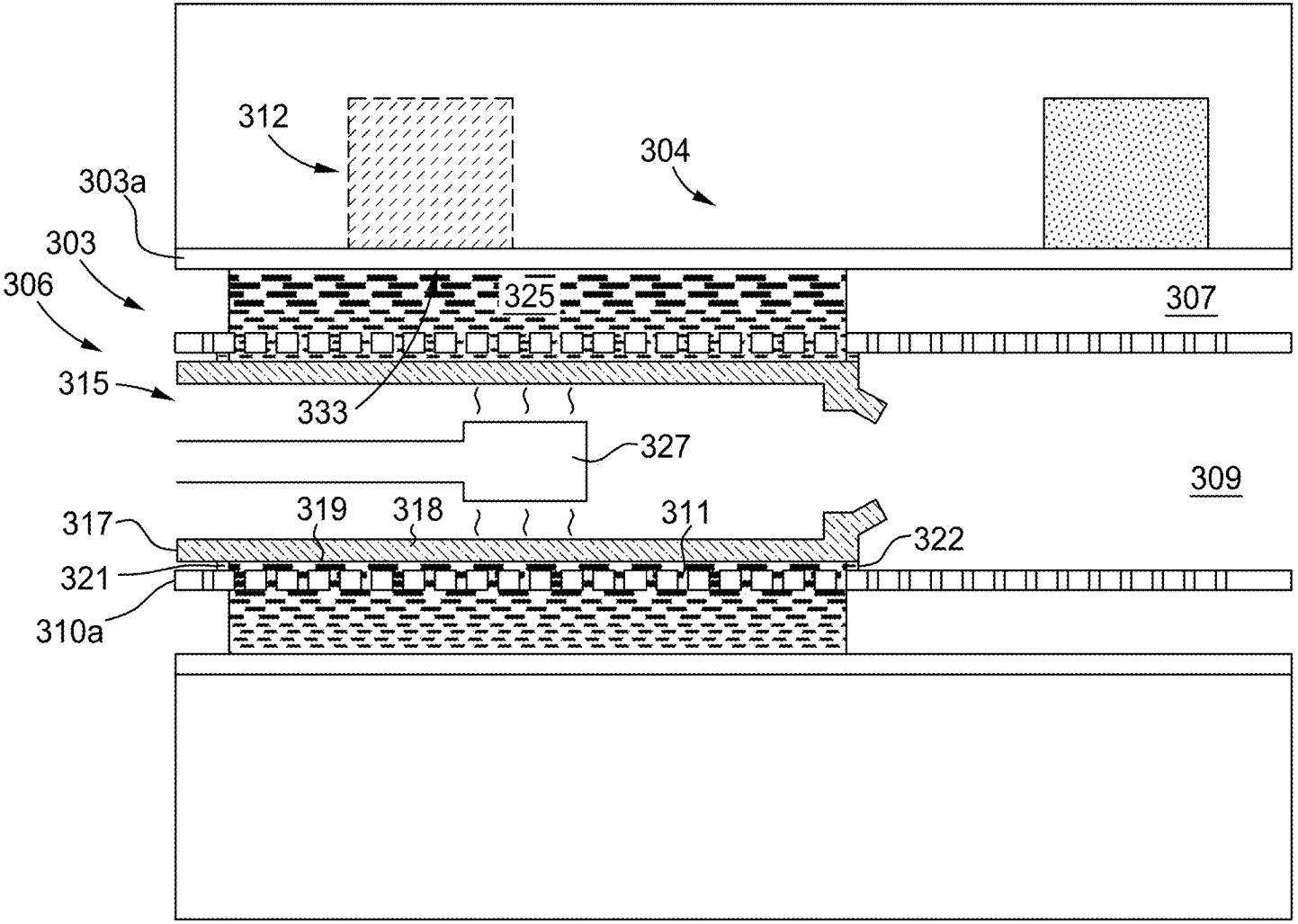
Figure 3E:
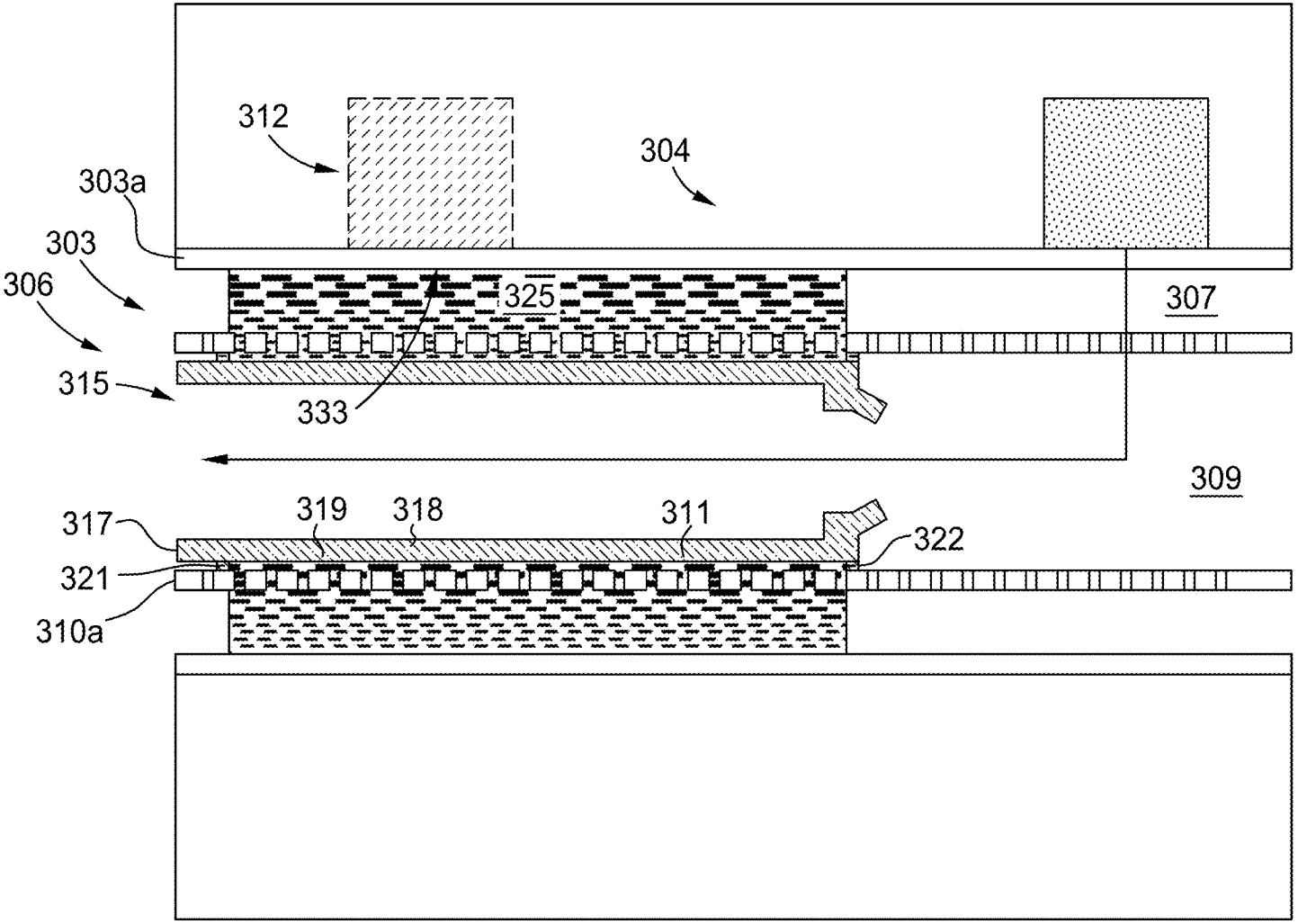

In one or more embodiments, and as shown in FIG. 3D, the sealing agent 325 is heat-activated. As illustrated, heat may be applied to the interior of the tubular patch 315. In one or more embodiments, the heat is applied by a downhole heating tool 327. The downhole tool 327 may heat the first chemical 320 and the second chemical 324 to activate the sealing agent 325. In one or more embodiments, activating the sealing agent 325 includes forming the sealing agent 325. That is, in one or more embodiments, the first chemical 320 and the second chemical 324 do not form the sealing agent 325 until they are exposed to heat. In one or more embodiments, activating the sealing agent 325 includes expanding the sealing agent 325. That is, the sealing agent 325 is formed by the interaction between the first chemical 320 and the second chemical 324, but the sealing agent 325 is not expanded until it is heated. In one or more embodiments, activating the sealing agent 325 includes curing the sealing agent 325 after it is expanded. That is, the sealing agent 325 is formed and expanded by the interaction between the first chemical 320 and the second chemical 324, but heat is used to cure the sealing agent 325 to seal the desired seal location.

Figure 3F:
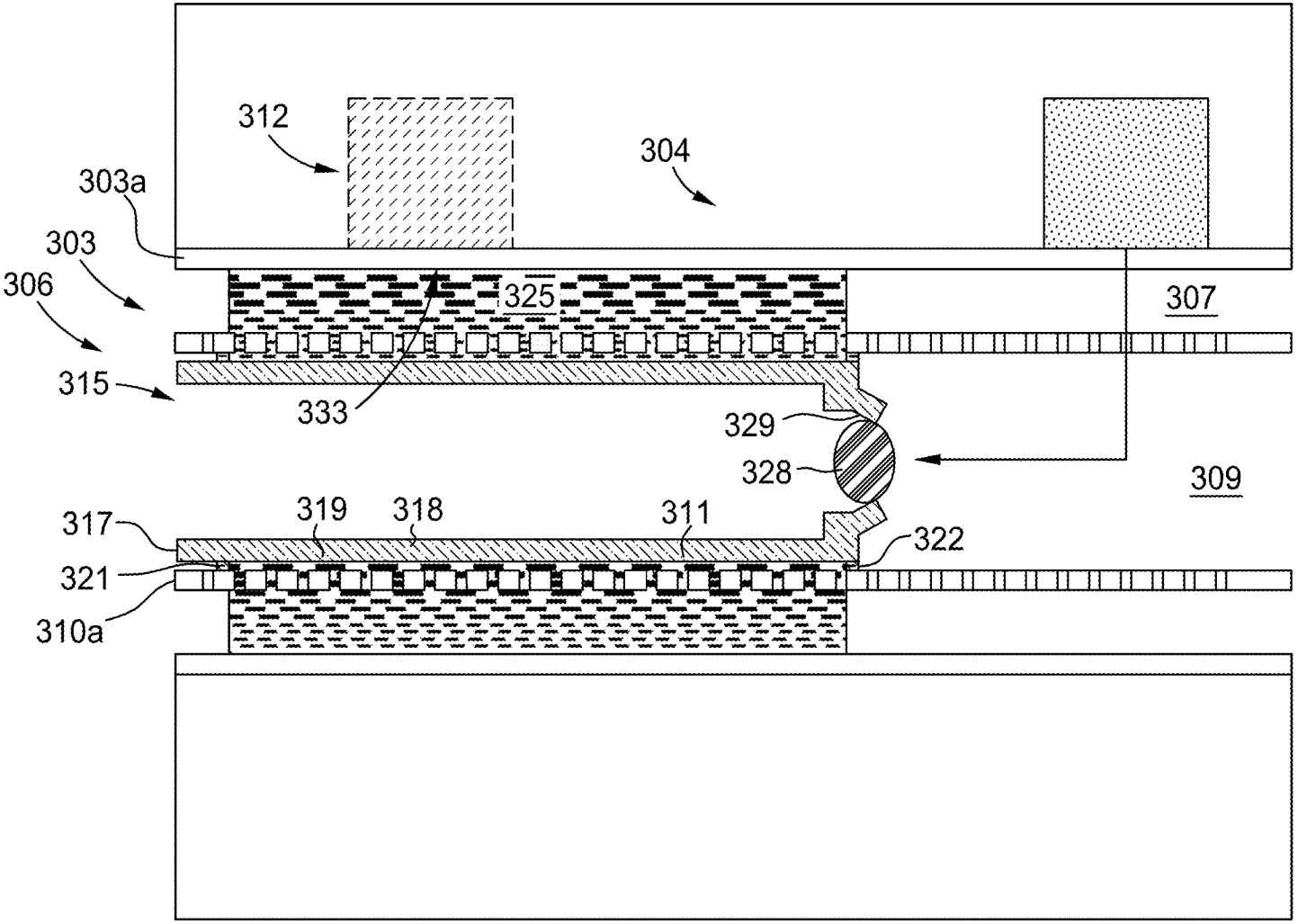

Optionally, before, after, or simultaneously with the first chemical 320 being exposed to the second chemical 324, the tubular patch 315 may be plugged. Plugging the tubular patch 315 may close fluid communication through the bore 309 of the tubular patch, as shown in FIG. 3F. In one or more embodiments, plugging the tubular patch 315 includes dropping a plug 328 (e.g., a ball) through the bore 309 of the tubular 306, through the bore of the tubular patch 315, and landing the plug 328 in a seat 329 (or the portion of the tubular body 317 with a narrowed inner diameter as discussed above). Accordingly, the tubular patch 315 and plug 328 may be used to plug (e.g., shutoff) the wellbore 103 below the tubular patch 315.

Figure 4:
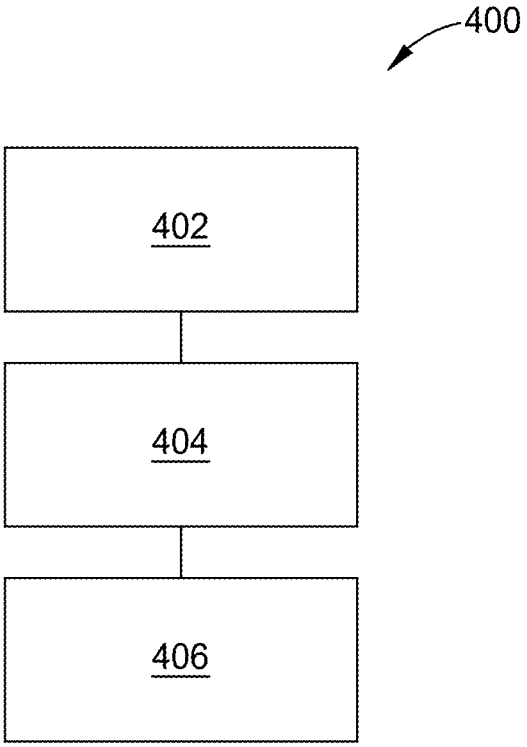
FIG. 4 illustrates another method for sealing an annulus of a wellbore, according to one or more embodiments.

FIG. 4 illustrates another method 400 for sealing an annulus (such as annulus 107 of FIG. 1) of a wellbore (such as wellbore 103 of FIG. 1). FIGS. 5A-5D schematically illustrate the method 400 for sealing an annulus 507 of a wellbore 503. The method 400 and tubular patch 515 are similar in operation and components to the method 200 and tubular patch 315. Accordingly, a description of like components and operations may not be repeated herein.

At operation 402, as shown in FIG. 5B, the tubular patch 515 is lowered into the tubular 506. In the presently illustrated embodiment, the tubular 506 is an unperforated tubing 510*b* disposed in an uncased wellbore 503. In some aspects, the tubular may comprise a bore 509, and the wellbore 503 may contain water 512. The tubular patch 515 is similar in components to the tubular patch 315 of FIGS. 3A-3F. However, the tubular patch 515 further includes a reservoir 530 containing the second chemical 524. The second chemical 524 is separated from the first chemical 520 so as to prevent premature exposure of the first chemical 520 to the second chemical 524. In one or more embodiments, the reservoir 530 is coupled to the tubular body 517. In one or more embodiments, the reservoir 530, is a rupturable reservoir and is configured to rupture due to an applied force. When a force is applied to the rupturable reservoir 530, the first chemical 520 is exposed to the second chemical 524. In one or more embodiments, such as the illustrated embodiment, the reservoir 530 is disposed about the first chemical 520. However, it is contemplated that the reservoir 530 may be disposed about the tubular body 517 and the first chemical 520 may be disposed about the reservoir 530. In some aspects, the tubular body 517 may include an inner surface 518.

In one or more embodiments, the reservoir 530 may not be rupturable and, rather may include valves, ports, or other selective opening mechanism. Accordingly, when the reservoir 530 is selectively opened the first chemical 520 is exposed to the second chemical 524. In one or more embodiments, the second chemical 524 and the first chemical 520 are both contained in a reservoir 530 and are separated by a membrane that is selectively rupturable, permeable, or openable to allow selective exposure of the first chemical 520 to the second chemical 524.

The presently illustrated embodiment illustrates tubular 106 as an unperforated tubing 510*b*. Accordingly, before operation 402, the unperforated tubing 510*b* is perforated to create perforations 511, as shown in FIG. 5A. The unperforated tubing 510*b* is perforated to give access to the annulus 507 (or other leak path in the formation 504 and/or wellbore wall 503*a*). The added perforations 511 allow the sealing agent 525 to access and seal the leak path 533. In one or more embodiments, the unperforated tubing 510*b* is perforated in only the portion of the unperforated tubing 510*b* corresponding to the desired sealing location. In one or more embodiments, the unperforated tubing 510*b* is perforated by a perforating tool 531. In other embodiments, the tubular 506 may comprise a first seal ring 521 and a second seal ring 522.

Figure 5C:
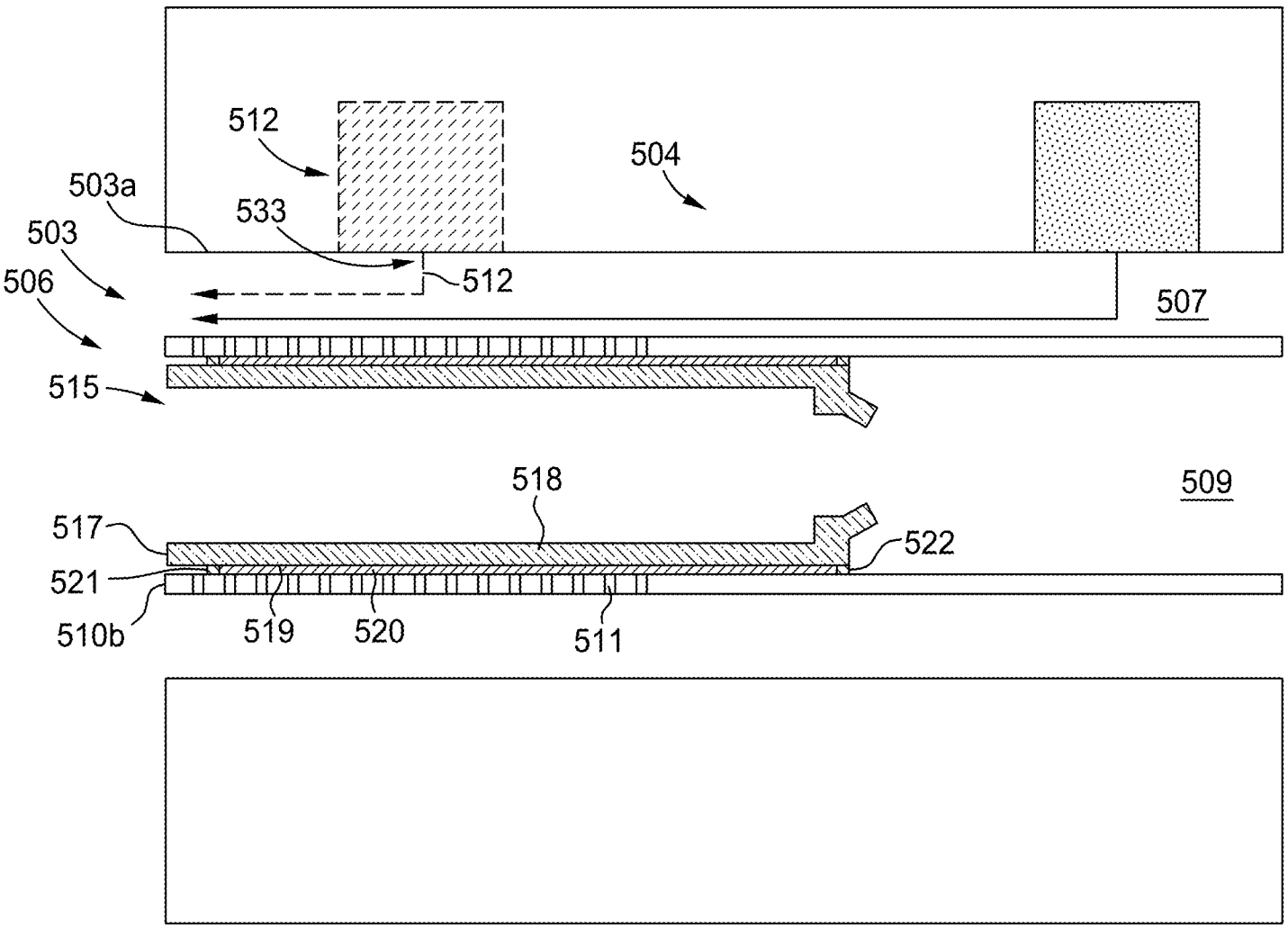
Figure 5D:
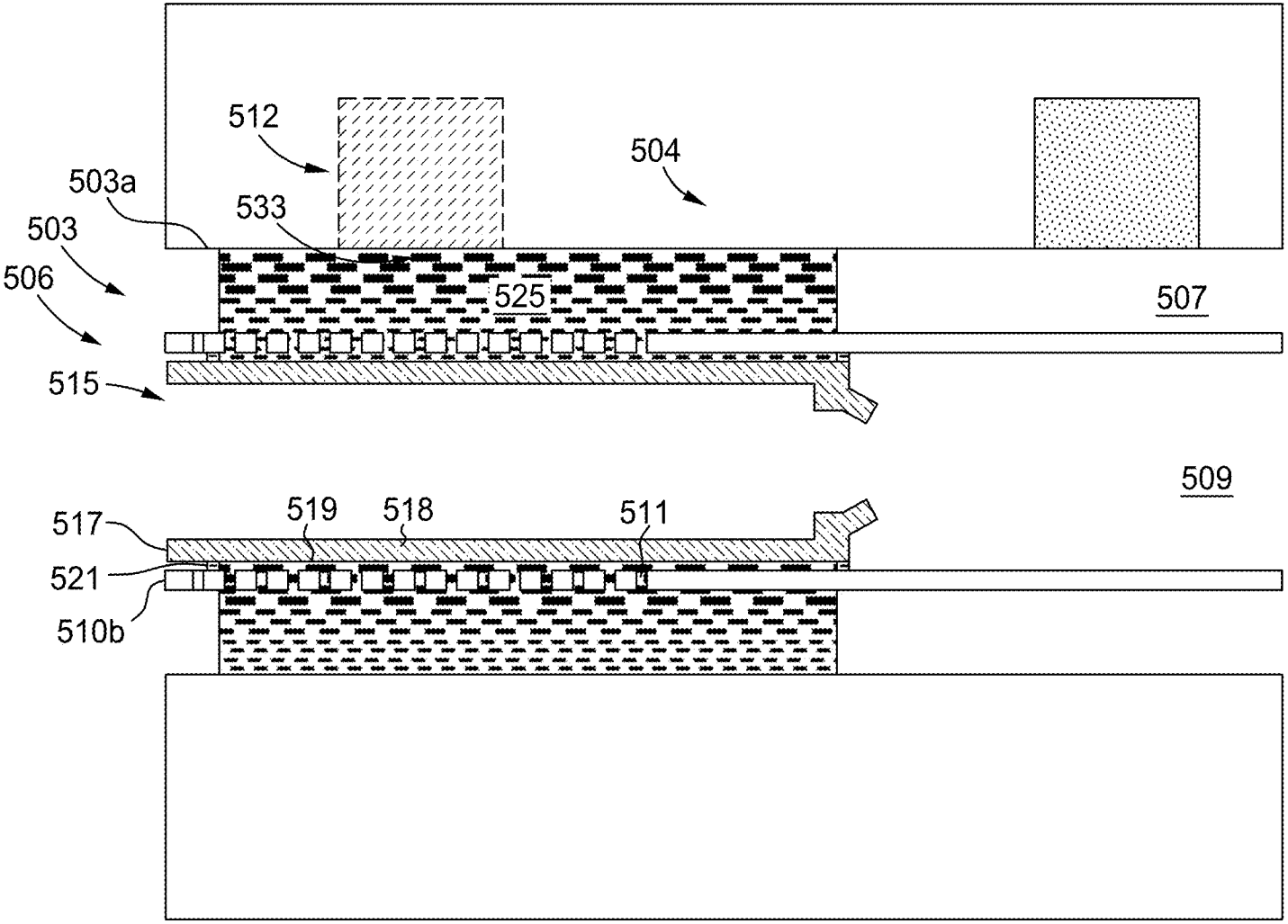

At operation 404 and as shown in FIG. 5C, the tubular patch 515 is expanded within the tubular 506 at the desired location similar to operation 204. The description of operation 204 is similarly applicable to operation 404 and, for brevity, the description will not be repeated, herein.

At operation 406, the first chemical 520 is exposed to the second chemical 524. Exposing the first chemical 520 to the second chemical 524 forms the sealing agent 525. The sealing agent 525 expands to fill empty space, as shown in FIG. 5C.

In one or more embodiments, exposing the first chemical 520 to the second chemical 524 includes selectively opening fluid communication between the first chemical 520 and the second chemical 524. In one or more embodiments, such as the illustrated embodiment, selectively opening fluid communication between the first chemical 520 and the second chemical 524 includes selectively opening the reservoir 530 containing the second chemical 524. In one or more embodiments, selectively opening the reservoir 530 includes rupturing the reservoir 530. In one or more embodiments, the rupturable reservoir 530 is disposed on the outer surface 519 of the tubular body 517 above (and/or below) the first chemical 520. Accordingly, expanding the tubular patch 515 against the inner surface of the tubular 506 at operation 404 causes the reservoir 530 to rupture thus exposing the first chemical 520 to the second chemical 524. When the first chemical 520 is exposed to the second chemical 524, the sealing agent 525 is formed and seals the leak path. The formation and activation of the sealing agent 525 has been described with respect to operation 206 and is repeated herein.

Any one or more components of the wellsites 100*a*, 100*b*, tubulars 106, and tubular patches 315, 515 may be integrally formed together, directly coupled together, and/or indirectly coupled together and are not limited to the specific arrangement of components illustrated in FIGS. 1-5D. Any one or more of the embodiments of the wellsites 100*a*, 100*b*, tubulars 106, tubular patches 315, 515, and/or methods 200, 400 may be combined in whole or part with any one or more of the embodiments of the wellsites 100*a*, 100*b*, tubulars 106, tubular patches 315, 515, and/or methods 200, 400.

EXAMPLE ASPECTS

Aspect 1: A method for sealing an annulus of a wellbore. The method including: lowering a tubular patch into a tubular to a desired seal location, wherein the tubular is disposed in a wellbore and includes one or more openings extending from an outer surface of the tubular to an inner surface of the tubular, the tubular patch including: an outer diameter of the tubular patch smaller than an inner diameter of the tubular and a first chemical disposed on an outer surface of the tubular patch; expanding the tubular patch within the tubular at the desired seal location; and exposing the first chemical to a second chemical, wherein the first chemical and second chemical react to form a sealing agent and the sealing agent expands through the one or more openings to fill an annulus between the tubular and the wellbore.

Aspect 2: The method of Aspect 1, wherein exposing the first chemical to the second chemical includes flowing the second chemical into the annulus between the tubular and the wellbore.

Aspect 3: The method of Aspect 2, wherein the second chemical is flowed into the annulus by at least a portion of the one or more openings.

Aspect 4: The method of Aspect 1, wherein exposing the first chemical to the second chemical includes rupturing a second chemical reservoir.

Aspect 5: The method of Aspect 4, wherein the second chemical reservoir is ruptured by expanding the tubular patch.

Aspect 6: The method of any of Aspects 1-5, wherein the tubular includes a sand screen at the desired seal location.

Aspect 7: The method of Aspect 6, wherein the desired seal location includes a portion of the sand screen.

Aspect 8: The method of any of Aspects 1-5, further comprising perforating the tubular to create the one or more openings.

Aspect 9: The method of any of Aspects 1-8, further comprising heating the sealing agent to cause the sealing agent to expand through the one or more openings to fill the annulus between the tubular and the wellbore.

Aspect 10: The method of any of Aspects 1-9, further comprising plugging an inner bore of the tubular patch.

Aspect 11: A method for sealing an annulus of a wellbore. The method including: lowering a tubular patch into a tubular to a desired seal location, wherein the tubular is disposed in a wellbore including a casing and the tubular includes one or more openings extending from an outer surface of the tubular to an inner surface of the tubular, the tubular patch including: an outer diameter of the tubular patch smaller than an inner diameter of the tubular and a first chemical disposed on an outer surface of the tubular patch; expanding the tubular patch within the tubular at the desired seal location; and flowing a second chemical to an outer surface of the tubular, wherein the outer surface of the tubular patch including the first chemical interacts with the second chemical, and wherein the interaction between the first chemical and the second chemical forms a sealing agent and the sealing agent expands to fill an annulus between the tubular and the casing.

Aspect 12: The method of Aspect 11, wherein the tubular includes a sand screen at the desired seal location.

Aspect 13: The method of Aspect 11, further comprising perforating the tubular to create the one or more openings.

Aspect 14: The method of any of Aspects 11-13, further comprising heating the sealing agent to cause the sealing agent to expand through the one or more openings to fill the annulus between the tubular and the wellbore.

Aspect 15: The method of any of Aspects 11-14, wherein flowing the second chemical includes flowing the second chemical with a downhole fluid displacement tool.

Aspect 16: The method of any of Aspects 11-14, wherein flowing the second chemical includes bullheading from a top side.

Aspect 17: The method of any of Aspects 11-16, further comprising deploying a plug into the tubular to divert the second chemical to the outer surface of the tubular.

Aspect 18: A system for sealing an annulus of a wellbore. The system including a tubular, a tubular patch, and a first chemical. The tubular includes one or more openings extending from an inner surface of the tubular to an outer surface of the tubular. The tubular patch is disposed within the tubular and includes one or more seal rings disposed about an outer surface of the tubular patch and configured to seal between the outer surface of the tubular patch and the tubular. The first chemical is disposed on the outer surface of the tubular patch. The first chemical is configured to react with a second chemical to expand from the outer surface of the tubular patch, through the one or more openings, and outwardly from the outer surface of the tubular.

Aspect 19: The system of Aspect 18, wherein the first chemical is configured to react with the second chemical to expand from the outer surface of the tubular patch when exposed to heat.

Aspect 20: The system of any Aspects 18 or 19, wherein the tubular patch further includes a first inner diameter and a second inner diameter, wherein the second inner diameter is less than the first inner diameter, and wherein the second inner diameter is disposed at a distal end of the tubular patch.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions.

While the present disclosure has been described with respect to a number of embodiments and examples, those skilled in the art, having benefit of this disclosure, will appreciate that other embodiments can be devised which do not depart from the scope and spirit of the present disclosure.

The preceding description, for purposes of explanation, uses specific nomenclature to provide a thorough understanding of the disclosure and is provided to enable any person skilled in the art to practice the various aspects described herein. However, it will be apparent to one skilled in the art, which the specific details are not required in order to practice the systems and methods described herein. The examples discussed herein are not limiting of the scope, applicability, or aspects set forth in the claims. They are not intended to be exhaustive of or to limit this disclosure to the precise forms described. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. The examples are shown and described in order to best explain the principles of this disclosure and practical applications, to thereby enable others skilled in the art to best utilize this disclosure and various examples with various modifications as are suited to the particular use contemplated. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim. It is intended which the scope of this disclosure be defined by the claims and their equivalents below.

What is claimed is:

1. A method for sealing an annulus of a wellbore, comprising:

lowering a tubular patch into a tubular to a desired seal location, wherein the tubular is disposed in the wellbore and includes one or more openings extending from an outer surface of the tubular to an inner surface of the tubular, wherein an outer diameter of the tubular patch is smaller than an inner diameter of the tubular, and wherein a first chemical is disposed on an outer surface of the tubular patch;

expanding the tubular patch within the tubular at the desired seal location; and exposing the first chemical to a second chemical, wherein the first chemical and the second chemical react to form a sealing agent, wherein the sealing agent expands from the outer surface of the tubular patch, through the one or more openings, and outwardly from the outer surface of the tubular to fill the annulus between the tubular and the wellbore, and wherein exposing the first chemical to the second chemical includes rupturing a second chemical reservoir.

2. The method of claim 1, wherein the second chemical reservoir is ruptured by expanding the tubular patch.

3. The method of claim 1, wherein the tubular is a sand screen at the desired seal location.

4. The method of claim 3, wherein the desired seal location includes a portion of the sand screen.

5. The method of claim 1, further comprising perforating the tubular to create the one or more openings.

6. The method of claim 1, further comprising plugging an inner bore of the tubular patch.

7. A method for sealing an annulus of a wellbore, comprising:

lowering a tubular patch into a tubular to a desired seal location, wherein the tubular is disposed in the wellbore including a casing and the tubular includes one or more openings extending from an outer surface of the tubular to an inner surface of the tubular, wherein an outer diameter of the tubular patch is smaller than an inner diameter of the tubular, and wherein a first chemical is disposed on an outer surface of the tubular patch;

expanding the tubular patch within the tubular at the desired seal location; and flowing a second chemical to an outer surface of the tubular, wherein the outer surface of the tubular patch including the first chemical interacts with the second chemical, wherein the interaction between the first chemical and the second chemical forms a sealing agent, wherein the sealing agent expands from the outer surface of the tubular patch, through the one or more openings, and outwardly from the outer surface of the tubular to fill the annulus between the tubular and the wellbore, and wherein flowing the second chemical includes bullheading from a top side.

8. The method of claim 7, wherein the tubular is a sand screen at the desired seal location.

9. The method of claim 7, further comprising perforating the tubular to create the one or more openings.

10. The method of claim 7, wherein flowing the second chemical includes flowing the second chemical with a downhole fluid displacement tool.

11. The method of claim 7, further comprising deploying a plug into the tubular.

* * * * *